United States Patent [19]

Ando

[11] 4,043,240

[45] Aug. 23, 1977

[54] ELECTRIC INSTRUMENT COMPRISING A BINARY COUNTER CLEARED WHEN COUNTS THEREIN REACH INTEGERS REPRESENTATIVE OF A MELODY

[75] Inventor: Fumio Ando, Tokyo, Japan

[73] Assignee: Nippon Electric Company, Ltd., Tokyo, Japan

[21] Appl. No.: 697,398

[22] Filed: June 18, 1976

[30] Foreign Application Priority Data

June 23, 1975 Japan ..... 50-77216
June 23, 1975 Japan ..... 50-77217

[51] Int. Cl.[2] ..... G10H 5/06
[52] U.S. Cl. ..... 84/1.01; 84/1.03
[58] Field of Search ..... 84/1.01, 1.03, 1.19, 84/1.24, 1.28, DIG. 11

[56] References Cited

U.S. PATENT DOCUMENTS

| | | | |
|---|---|---|---|
| 3,743,756 | 7/1973 | Franssen et al. | 84/1.01 |
| 3,808,345 | 4/1974 | Franssen | 84/1.01 |
| 3,878,750 | 4/1975 | Kapps | 84/1.01 |
| 3,895,554 | 7/1975 | Maillet | 84/115 |
| 3,962,944 | 6/1976 | Sakashita | 84/1.01 |

*Primary Examiner*—Robert K. Schaefer
*Assistant Examiner*—Vit W. Miska
*Attorney, Agent, or Firm*—Ostrolenk, Faber, Gerb & Soffen

[57] ABSTRACT

For producing musical sounds of a pure scale, an electric instrument comprises a clock generator for producing clock pulses of a period equal to a rational multiple of a predetermined period that gives, when multiplied by integers, tones within an octave of the scale. A binary counter counts input pulses derived from the clock pulses. Keys or a memory produces binary signals corresponding to the integers in accordance with a melody. When counts in the counter reach the value of the integers, wired logic circuits clear the counter. The periods at which the counter is cleared produce the melody. In order to correct pitches of several tones, the clock pulses are controlled on deriving the input pulses therefrom either by algebraic addition of pulses or variable division of the clock pulses into groups. With this control, the instrument can produce tones of a chromatic scale within five additional tones within an octave are of a tempered scale.

6 Claims, 5 Drawing Figures

ELECTRIC INSTRUMENT COMPRISING A BINARY COUNTER CLEARED WHEN COUNTS THEREIN REACH INTEGERS REPRESENTATIVE OF A MELODY

BACKGROUND OF THE INVENTION

This invention relates to an electric musical instrument, which may be a music synthesizer, an electric music box, an electric chime, or the like.

An electric instrument of the type specified is used as a sound source indicative of a hold condition on telephone lines, as a traffic signal for the blind, and for other non-musical purposes in addition to conventional musical purposes. Conventional electrical instruments, however, are defective in that the instrument is either bulky or unreliable in the presence of secular and/or temperature changes or in that it is not easy to encode a melody for operation of the instrument.

SUMMARY OF THE INVENTION

It is therefore an object of the present invention to provide a compact and reliable electric musical instrument.

It is another object of this invention to provide an electric musical instrument of the type described, for which it is not difficult to encode a melody.

An instrument according to this invention is for electrically digitally producing a melody comprising musical sounds of a musical scale consisting of a plurality of tones within an octave. The tones have fundamental periods equal to a predetermined period multiplied by integers, the above-mentioned plurality in number. The integers are called herein tone integers for purposes of differentiation from integers of other sorts. In accordance with this invention, the instrument comprises first means for producing pitch binary signals in compliance with the melody. Each of the pitch binary signals comprises a plurality of digits representative of a pitch integer. Such pitch integers are related to the tone integers to specify the musical sounds. The instrument further comprises a tone clock generator for producing a train of tone clock pulses of a tone clock period equal to a rational multiple, which may be unity, of the predetermined period, second means responsive to the clock pulses and binary signals for producing electric pulse groups wherein the electric pulses have repetition periods equal to the predetermined period multiplied by the tone integers to which the pitch integers are related, and third means responsive to the pulse groups for producing the melody.

BRIEF DESCRIPTION OF THE DRAWING

FIG. 1, is a block diagram of an electric musical instrument according to a second embodiment of this invention;

DESCRIPTION OF THE PREFERRED EMBODIMENTS

Figure 1:
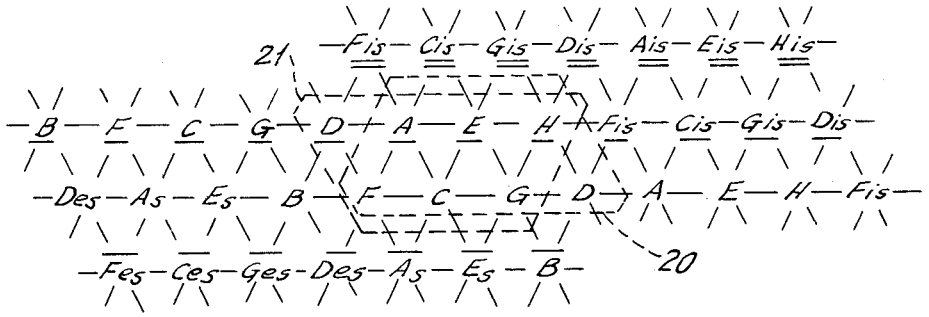
FIG. 1 shows notations of tones used in the instant specification together with major and natural minor musical scales.

Referring to FIG, 1, initially a description will be given of musical scales and of notations of tones used in describing the present invention, with musical intervals of one or more octaves being neglected for purposes of simplicity. In a well-known manner, a first tone (for example, C) written to the right of a second tone (F) is a pure perfect fifth above (3:2 in the ratio of frequencies) the first tone, while the second tone is a pure perfect fourth above (5:4 in the frequency ratio) the first. A tone higher than a first tone by an apotome (2187:2048 in the frequency ratio) is designated with addition of an ending "is" to the notation of the first tone. A tone lower than a first tone by an apotome (2048:2187 in the frequency ratio) is denoted with another ending "es" with the exceptions of "As" and "Es" for "Aes" and "Ees" and of "B" for "Hes" (or "H" for "Bis"). With these notations, a tone which is a pure major third above (5:4 in the frequency ratio) C, for example, is E where an underscore represents that the pitch is a syntonic comma below (80:81 in the frequency ratio) E. A tone which is a syntonic comma higher (81:80 in the frequency ratio) is represented with a bar above the notation, such as B which appears as a tone a pure minor third above (6:5 in the frequency ratio) G. Heptaphonic tones, or seven tones, within an octave of the pure major diatonic scale, namely, the major diatonic scale of just intonation, with the keynote of C lie within a block 20, while those for a pure minor diatonic scale, called the natural minor scale, with the keynote of A lie written in another block 21. The actual frequency of the tone $a^1$ or $a_1$ is 440 Hz.

Figure 2:
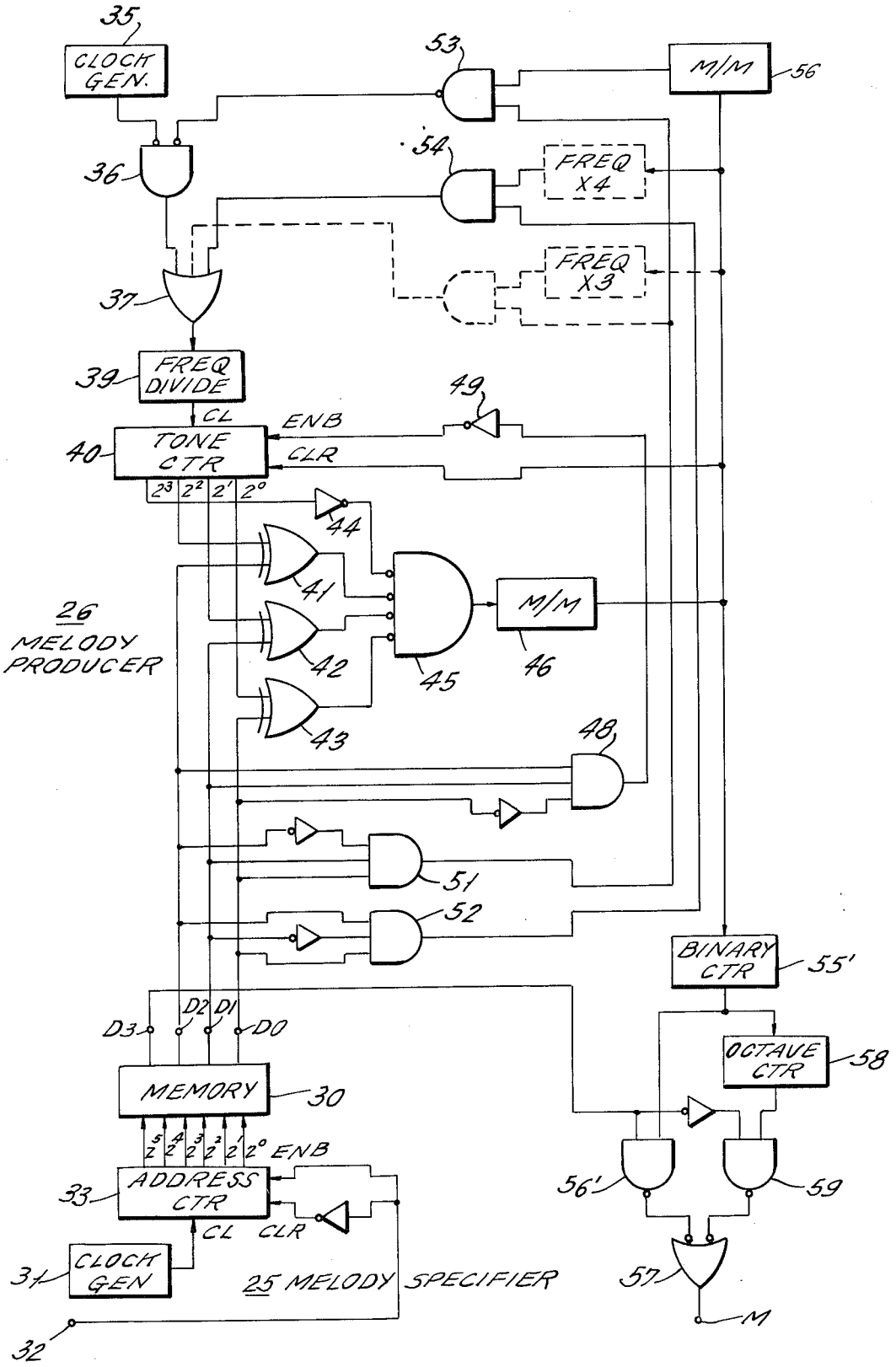
FIG. 2 is a block diagram of an electric musical instrument according to a first embodiment of the present invention.

Referring now to FIG. 2, an electric musical instrument according to a first embodiment of this invention is provided for digitally producing a melody comprising musical sounds which are within two octaves of a pure heptatonic diatonic scale, namely, are of fourteen tones including, for example, $c^1$ and $h^2$. For convenience of description of the first embodiment, reference will be made to Tables 1 and 2 for the major scale 20 and the natural minor scale 21. In both tables, "Frequ" and "Per" represent relative frequencies and periods. "App.per" represents, together with corrections or errors in parentheses, approximate relative periods into which the relative periods are modified in accordance with this invention. The approximate relative periods are reducible to reduced approximate periods or Red.per which can be give by binary numbers of four digits in the example being illustrated. In Tables 1 and 2, the approximate relative periods have greatest common measures 12 and 3, respectively. Absolute periods for C, D, . . in Table 1 are a predetermined period, 1/(440 × 108) second, multiplied by 180, 160, . . .

Table 1

| Tone | Freq | Per | App. per | Red. per | Binary |
|---|---|---|---|---|---|
| H | 45 | 96 | 96 | 8 | 1000 |
| A | 40 | 108 | 108 | 9 | 1001 |
| G | 36 | 120 | 120 | 10 | 1010 |
| F | 32 | 135 | 132 (−3) | 11 | 1011 |
| E | 30 | 144 | 144 | 12 | 1100 |
| D | 27 | 160 | 156 (−4) | 13 | 1101 |
| C | 24 | 180 | 180 | 15 | 1111 |

Table 2

| Tone | Freq | per | App. per | Red. per | Binary |
|---|---|---|---|---|---|
| E | 180 | 24 | 24 | 8 | 1000 |

Table 2-continued

| Tone | Freq | per | App. per | Red. per | Binary |
|---|---|---|---|---|---|
| D | 160 | 27 | 27 | 9 | 1001 |
| C | 144 | 30 | 30 | 10 | 1010 |
| H | 135 | 32 | 33 (+1) | 11 | 1011 |
| A | 120 | 36 | 36 | 12 | 1100 |
| G | 108 | 40 | 39 (−1) | 13 | 1101 |
| F | 96 | 45 | 45 | 15 | 1111 |

Those for F, G, . . . in Table 2 are another predetermined period, 1/(440 × 36) second, multiplied by 45, 40, . . . In other words, the tones given in these tables have periods equal to a predetermined period multiplied by integers which are herein refered to as tone integers. Exactly speaking, the periods mentioned above are fundamental periods. Inasmuch as the most significant digit of each binary number is 1, it is possible according to this invention to make 0 in this digit represent tones that are inversions of, namely, an octave below the tones with 1 in this digit as will become clear later. Furthermore, it is possible to make a binary number 1110 represent a rest. Further looking at Tables 1 and 2, it is understood that the relative periods are given by the tone integers consisting of five first tone integers having a greatest common measure 12 or 3 and two second tone integers equal to algebraic sums of the greatest common measure multiplied by integral factors 11 and 13 for the respective second tone integers plus errors or corrections which are, as given in the parentheses, not greater in absolute value than about one-tenth of the respective second integers.

Referring more particularly to FIG. 2, the instrument comprises a melody specifier or melody specifying signal producer 25 and a melody producer 26. The melody specifier 25 comprises a memory 30 for a melody and a beat clock generator 31. In the example being illustrated, the memory 30 is a four-bit 64-word read-only memory, namely, a memory having sixty-four addreses, each for a word of four bits. Tones and rests of a melody are encoded according to the binary numbers mentioned above and are stored in the respective addresses with durations of the tones and rests given by the number of words. The clock generator 31 produces beat clock pulses of a beat clock period determined with reference to the tempo of the melody and to the shortest duration, such as an eighth or a sixteenth note, that appears in the melody. The melody specifier 25 further comprises a start-stop terminal 32 and an address counter 33. When the memory 30 is made up of 64 words, it is sufficient that the counter 33 be a six-bit binary counter having six output leads for binary numbers $2^0 2^1$, $2^2$, $2^3$, $2^4$, and $2^5$. The counter 33 further has a clock terminal CL, an enable terminal ENB, and a clear terminal CLR. A start-stop signal supplied to the start-stop terminal 32 is switched from logic 0 to logic 1 when it is desired to put the instrument into operation, kept at logic 1 so long as it is desired to play the instrument, and switched back to logic 0 when it is desired to stop playing. This signal is supplied to the enable terminal ENB and, through an inverter, to the clear terminal CLR. While enabled by the logic 1 start-stop signal, the counter 33 counts the beat clock pulses supplied to the clock terminal CL and produces successively increasing address signals 000000, 000001, . . . , and 111111 representative in binary numbers of the addresses of the memory 30. Responsive to the address signals, the memory 30 produces a sequence of melody specifying binary signals at signal terminals D0, D1, D2, and D3 for the respective digits $2^0$, $2^1$, $2^2$, and $2^3$ of the binary numbers representative of notes and rests. The binary signals are representative of the reduced periods 8, 9, 10, 11, . . . and correspond, when the melody is in the natural minor scale 21, to the relative periods 24, 27, 30, 32 (rather than 33), . . . The counter 33 endlessly cylically produces the address signals (i.e. continues to repeat the melody until the start-stop signal is switched to 0 to disable the counter 33 and clear the same to a count of 000000.

Further referring to FIG. 2, it is presumed for simplicity of description that the melody is of the natural minor scale 21 as already referred to in the next preceding paragraph. The melody producer 26 comprises a tone clock generator 35 for producing a train of tone clock pulses of a tone clock frequency 63,360 Hz, namely, of a tone clock period 1/(440 × 144) second which is the predetermined period 1/(440 × 36) second multiplied by a rational number ¼ or is 1/(440 × 36 × 4) second. The tone clock pulses are supplied through an input NAND gate 36 and an input OR gate 37, described later in detail, to a frequency divider 39 which divides the tone clock frequency by three, namely, the greatest common measure, i.e. multiplies the tone clock period by three. The frequency-divided tone clock pulses are supplied as tone pulses to a clock terminal CL of a controllable four-bit binary tone counter 40 which successively delivers tone count signals representative of counts in binary numbers of the tone pulses to four output leads for the respective digits $2^0$, $2^1$, $2^2$, and $2^3$ of the count-representative binary numbers. First, second, and third Exclusive OR gates 41, 42, and 43 receive the next most significant through the least significant digits of the count-representative and melody-specifying binary numbers with the exception of the most significant digits of the respective binary numbers. The most significant digit of the count-representative binary number is supplied to an inverter 44. Output signals of the inverter 44 and the Exclusive OR gates 41 through 43 are supplied to a four-input NAND gate 45 which delivers an electric pulses to a first monostable multivibrator 46. Responsive to transition from logic 0 to logic 1 of the electric pulse, the monostable multivibrator 46 produces a first pulse which is supplied, among others, to a clear terminal CLR of the tone counter 40. The first pulse has a pulse width between one and two clock periods. The three less significant digits of each melody-specifying binary number are supplied to a rest AND gate 48, with the least significant digit inverted. A rest output signal of the rest AND gate 48 is supplied through an inverter 49 to an enable terminal ENB of the tone counter 40. When the melody-specifying binary number is 1110 to represent a rest, the tone counter 40 is disabled. First and second correction AND gates 51 and 52 are supplied with the three less significant digits of the melody-specifying binary number, through inverters for pertinent digits, to deliver correction signals to an addition NAND gate 53 and a reduction AND gate 54 when the three digits are 011 and 101, respectively. The first pulse is supplied also to the reduction AND gate 54 and to a second monostable multivibrator 56 which supplies, in response to transition from logic 0 to logic 1 of the first pulse, a second or addition pulse to the addition NAND gate 53. The addition pulse is of a pulse width sufficiently shorter than a half of the tone clock period.

In operation, let it be surmised at first that the three less significant digits of a melody-specifying binary number is 000. When the count in the tone counter 40 reaches 1000, the four-input NAND gate 45 delivers a logic 1 electric pulse to the first monostable multivibrator 46, which produces a first pulse to clear and put the tone counter 40 back into operation before application thereto of a tone pulse that next follows the pulse counted thereby as a last one of binary 1000 (decimal eight) tone pulses. In this manner, the tone counter 40 is cleared at every eight frequency-divided tone clock pulses or every 24 tone clock pulses with the result that a tone logic circuit comprising the elements 41 through 45 produces a group of electric pulses once every 24/(440 × 144) second. In other words, the maximum count of the tone counter 40 is controlled to reach a count of twenty-four in terms of the tone clock pulses. Similarly, the logic circuit produces groups of electric pulses of repetition periods equal to 27/(440 × 144), 30/(440 × 144), 36/(440 × 144), and 45/(440 × 144) second when the three less significant digits are 001, 010, 100,and 111, respectively. When the three digits are 011, the first correction AND gate 51 makes the addition and input NAND gates 53 and 36 supply an additional pulse through the input OR gate 37 to the tone clock pulses each time the second monostable multivibrator 47 produces an addition pulse in response to a first pulse that clears the tone counter 40. Under these circumstances, the tone clock pulses are increased by only because a sufficiently short-width logic 1 pulse is put in an otherwise single logic 0 tone clock pulse supplied to the input OR gate 37. The tone counter 40 therefore counts eleven tone pulses (32 tone clock pulses one of which is divided into two) during the 32 tone clock periods. As a result, logic circuit produces a group of electric pulses of a repetition period equal to 32/(440 × 144) second rather than to 33/(440 × 144) second. When the three digits are 101, the second correction AND gate 52 makes the reduction AND gate 54 produce a logic 1 pulse of a pulse width of the first pulse each time when the first pulse clears the tone counter 40. The reduction is carried out by superposing the logic 1 pulse on the logic 0 pulse interposed between two adjacent logic 1 tone clock pulses supplied to the input OR gate 37. Consequently, the logic circuit produces another group of electric pulses of a repetition period equal to 40/(440 × 144) second rather than to 39/(440 × 144) second.

Still further referring to FIG. 2, the melody producer 26 further comprises another binary counter 55' for producing melody pulses of a 50% duty cycle of a repetition period equal to twice the repetition period of the first or electric pulses in response to the first pulses. When the most significant digit of the melody specifying binary signals supplied to the signal terminal D3 of memory 30 is logic 1, the melody pulses passes through a NAND gate 56' and a NOR gate 57 to an electroacoustic transducer M. The melody pulses are supplied also to an octave binary counter 58 for twice multiplying the repetition periods of the melody pulses. When the most significant digit of the melody specifying binary number is logic 0, the twice-repitition-period melody pulses pass through another NAND gate 59 and the NOR gate 57 to the transducer M.

It will now be understood, for production of tones of the pure major scale 20, that the tone clock period may be 1/(440 × 108 × 4) second by the use of a one-twelfth frequency divider or a duodecimal counter 39. In order to change or modify 160 tone clock pulses into 13 tone pulses in response to the second pitch integer 101 for the tone D, a frequency multiplier or an equivalent illustrated with a broken-line block may be interposed between the first monostable multivibrator 46 and the reduction AND gate 54 to supply wide logic 1 pulses four times in each repetition period of the electric pulses to the input OR gate 37. Similarly, a second reduction AND gate and a second frequency multiplier may be interposed between the input OR gate 37 and the first monostable multivibrator 46 with the output signal of the first AND gate 51 supplied as a second input signal to the second AND gate as depicted with broken lines. This enables 135 tone clock pulses to be modified into 11 tone pulses in response to the second pitch integer 011 for the tone F.

It is possible by the use of one or two additional digits for the melody specifying binary signals to make an instrument according to the first embodiment produce a melody within three or up to five octaves. It is also possible to produce the melody specifying binary signals by manually touching keys of a keyboard instrument rather than by a memory 30. The keys are in effect switches or the like. It will now be appreciated that an instrument according to the first embodiment is simple in structure as compared with a conventional one with an equal capacity and that the digital structure of the instrument insures reliable performance.

Referring again to FIG. 2, an instrument according to the first embodiment may now be modified so as to produce a melody comprising tones within two octaves of a minor chromatic scale if the scale comprises those five additional tones within an octave, each of which has a relative period determined by an arithmetic mean of the relative periods of two adjacent tones of a musical interval equal to a major or a minor tone rather than by a geometric mean, by an apotome, or as a tone a diatonic or a modern chromatic semitone above (16:15 or 25:24 in the frequency ratio) the lower one of the two adjacent tones as given in Table 3. It should be understood here that the scale is given as an ascending chromatic scale merely for convenience of notation and that the ending "is" is used in a broader-meaning as is often the case. Inasmuch as the melody specifying binary numbers are now of five digits, use is made of an additional signal terminal D4 (not shown in FIG. 2), the additional terminal D4 being for the most significant digit. A rest may be given by a binary numer 11111. The tone clock period may be 1/(440 × 72 × 4) second when use is made of a one-third frequency divider 39. Corrections for the input pulse to the binary counter 40 should be made for four less significant digits 0110, 0111, 1001, and 1100 by the use of a correction logic comprising four-input AND gates with pertinent inverters instead of the first and second AND gates 51 and 52 with inverters.

Table 3

| Tone | Per | App. per | Red. per | Binary |
|---|---|---|---|---|
| E | 48 | 48 | 16 | 10000 |
| Dis | 51 | 51 | 17 | 10001 |
| D | 54 | 54 | 18 | 10010 |
| Cis | 57 | 57 | 19 | 10011 |
| C | 60 | 60 | 20 | 10100 |
| H | 64 | 66 (+2) | 22 | 10110 |
| Ais | 68 | 69 (+1) | 23 | 10111 |
| A | 72 | 72 | 24 | 11000 |
| Gis | 76 | 75 (−1) | 25 | 11001 |
| G | 80 | 78 (−2) | 26 | 11010 |
| Fis | 85 | 84 (−1) | 28 | 11100 |
| F | 90 | 90 | 30 | 11110 |

It will now be easy for those skilled in the digital art to further modify an instrument according to the first embodiment to adapt the same to production of tones of a similar chromatic scale.

Figure 3:
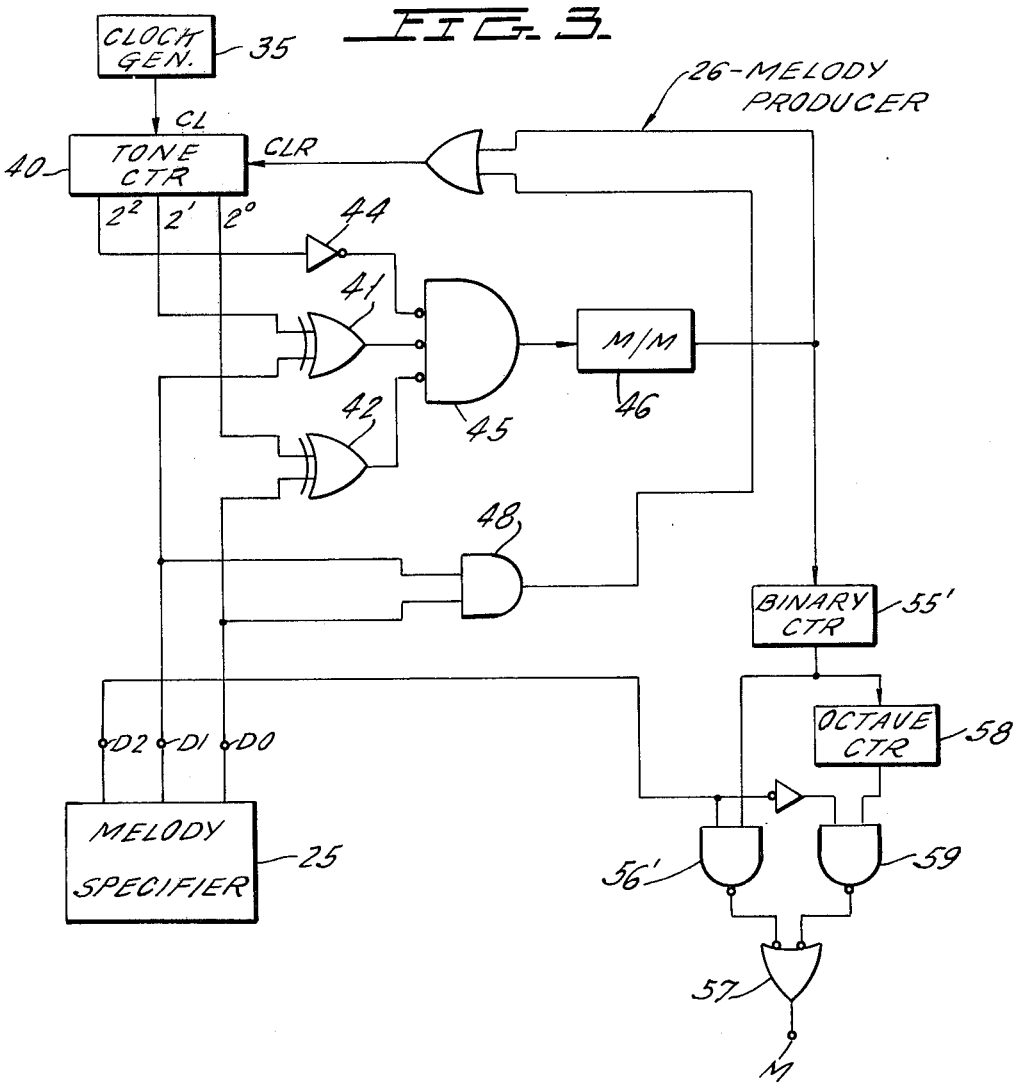
FIG. 3, depicted below

Referring now to FIG. 3, an electric musical instrument according to a second embodiment of this invention is a more simplified one for producing a melody composed of A, C, and E of the natural minor scale 21 within an octave, namely, of three tones consisting, for example, of $a^1$, $c^2$, and $e^2$. As is well-known, these three tones are a set of pure minor triads (specified in FIG. 1 by a triangle having a vertex below the opposite side) and have relative periods 6:5:4. It is therefore possible to represent these three tones with binary numbers 10, 11, and 00 and to assign a binary number 11 to a rest. An instrument according to the second embodiment comprises similar elements designated with like reference numerals as those used in FIG. 2. As will be seen from FIG. 3, a rest signal may be supplied through an OR gate to the clear terminal CLR of the tone binary counter 40. The tone clock period may be $1/(440 \times 6)$, namely, the predetermined period itself. If the melody is composed of six tones within two octaves including, for example, $a$ and $e^2$ on both ends, use is necessary of three-digit melody specifying binary numbers. With an instrument according to a modification of the second embodiment, it is possible to produce tones C, E, and G of pure major triads by modifying the relative periods 180:144:120 to approximate relative periods 180:150:120 which are reducible to 6:5:4 with a correction of $-6$ for the tone E.

Figure 4:
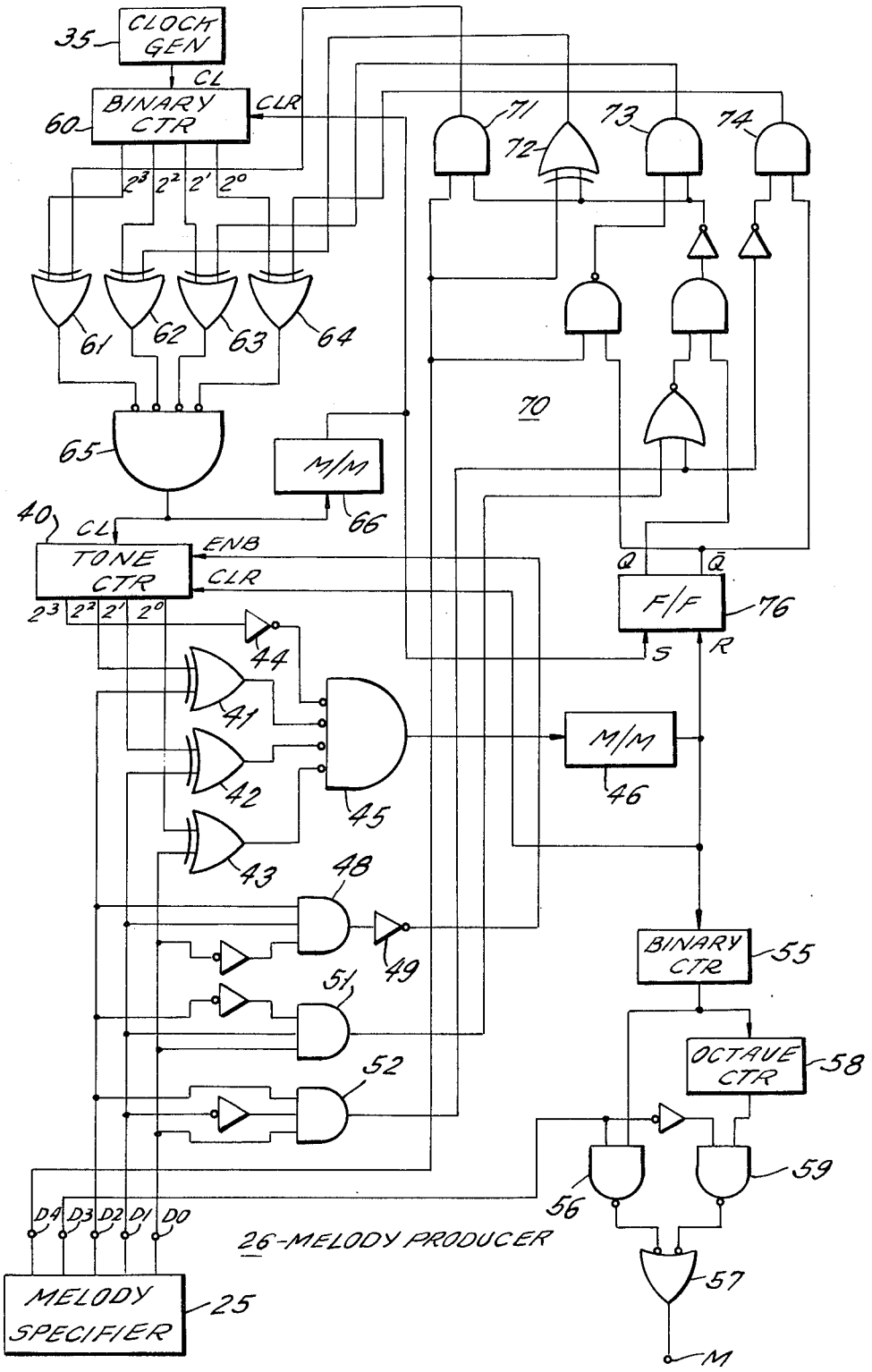
FIG. 4 is a block diagram of an electric musical instrument according to a third embodiment of this invention.

Next referring to FIG. 4, an electric musical instrument according to a third embodiment of this invention comprises means for controllably dividing the tone clock pulses into groups. An example of the instruments according to the third embodiment will be described in conjunction with a major chromatic scale. For simplicity of circuitry, each of five additional tones within an octave is again determined so as to have a relative period given by an arithmetic mean of the relative periods of two adjacent tones having an interval equal to a major of a minor tone. Furthermore, one of the heptaphonic tones, F, and three of the additional tones, Des, Es, and Ges, are determined so as to have practical relative periods (prac.per), the ending es and consequently B being used in the broader sense. These tones are given in Table 4 as tones of a descending chromatic scale merely for convenience of notation wherein "Bin.-code" refers to binary codes used in encoding a melody. The binary codes facilitate encoding and give compatibility to the instrument in respects of the memory 30, if used, and the melody producer 26.

Table 4

| Tone | Per | Prac. per | App. per | Red. per | Binary | Bin. code |
|---|---|---|---|---|---|---|
| H | 96 | 48 | 48 | 8 | 1000 | 0000 |
| B | 102 | 51 | 48 (−3) | 8 | 1000 | 1000 |
| A | 108 | 54 | 54 | 9 | 1001 | 0001 |
| As | 114 | 57 | 54 (−3) | 9 | 1001 | 1001 |
| G | 120 | 60 | 60 | 10 | 1010 | 0010 |
| Ges | 127.5 | 63 | 60 (−3) | 10 | 1010 | 1010 |
| F | 135 | 68 | 66 (−2) | 11 | 1011 | 0011 |
| E | 144 | 72 | 72 | 12 | 1100 | 0100 |
| Es | 152 | 75 | 72 (−3) | 12 | 1100 | 1100 |
| D | 160 | 80 | 78 (−2) | 13 | 1101 | 0101 |
| Des | 170 | 84 | 78 (−6) | 13 | 1101 | 1101 |
| C | 180 | 90 | 90 | 15 | 1111 | 0111 |

The tones given by the practical relative periods differ at most from the tones of equal temperament of twelve degrees only by 19 cents and serve well as practical tone for simple instruments. When the irregularities in arithmetic differences between two adjacent practical relative periods of lower tones are adjusted, the scale given in Table 4 coincides with that already described in conjunction with Table 3. This is natural because Tables 3 and 4 are for tones of tempered scales. in Table 4, it should be noted that corrections are necessary for two of the heptaphonic tones D and F as was the case with the tones listed in Table 1 and for all additional tones which are encoded with a binary 1 in the most significant digit. The difference in octave may be specified by an additional digit interposed between the most significant digit and the four less significant digits of the binary codes. A rest is given by a binary code 0110.

Referring more specifically to FIG. 4, an instrument according to the third embodiment again comprises similar elements designated with like reference numerals as in FIG. 2. In addition to such elements, the instrument comprises an additional signal terminal D4 for the digit that specifies whether the binary codes represent the heptaphonic or the additional tones. Instead of the mere frequency divider 39 and the input NAND and OR gates 36 and 37, use is made of a four-bit controllable binary counter 60 for producing controllably frequency-divided tone clock pulses in response to the tone clock pulses supplied to its clock terminal CL, first, second, third, and fourth Exclusive OR gates 61, 62, 63, and 64 for the most through least significant digits of count signals produced by the binary counter 60, a four-input NAND gate 65 for the Exclusive OR gates 61 through 64 for supplying controlled clock pulses or the tone pulses to the four-bit tone counter 40, and a correction monostable multivibrator 66 responsive to each of the tone pulses for producing a clear pulse of a pulse width sufficiently shorter than a half of the tone clock period. The tone clock period may be $1/(440 \times 54 \times 4)$. The clear pulse is supplied to a clear terminal CLR of the binary counter 60 to clear the same. A correction logic circuits 70 includes the first and second AND gates 51 and 52, AND and Exclusive OR gates 71, 72, 73, and 74 for supplying a correction binary signal to the first through fourth Exclusive OR gates 61 through 64, respectively, and an R-S flip-flop 76 set by each of the clear pulses to produce a high Q output signal and reset by each of the first pulses to produce a high $\overline{Q}$ output signal.

In operation, it would readily be understood by those skilled in logic circuitry that the AND and Exclusive OR gates 71 through 74 produce a correction binary signal 0110 (decimal six) irrespective of the set and reset states of the R-S flip-flop 76 when the melody specifying binary signal is for one of the tones C, E, G, A, and H for which corrections are unnecessary. The four-input NAND gate 65 makes the correction monostable multivibrator 66 produce a clear pulse to clear the binary counter 60 each time when the latter counts six tone clock pulses. Under the circumstances, the binary counter 60 acts as a one-sixth frequency divider. The tone counter 40 therefore makes the first monostable multivibrator 46 produce the first pulses of the repetition period $48/(440 \times 216)$, $54/(440 \times 216)$, $60/(440 \times 216)$, or $90/(440 \times 216)$ second. For each of the tones D and F, the AND and Exclusive OR gates 71 and 74 produce a correction signal 1000 (decimal eight) in response to the binary codes 0011 and 0110 when the flip-flop 76 is in the reset state. The four-input NAND gate 65 therefore makes the correction monostable multivibrator 66 produce a clear pulse to clear the binary counter 60 when the latter counts eight tone clock pulses. The clear pulse sets the flip-flop 76. When the flip-flop 76 is in the set state, the correction logic 70 produces a correction signal 0110 from the AND and Exclusive OR gates 71 through 74 irrespective of the binary codes of the melody specifying signals. The binary counter 60 again acts as a one-sixth frequency divider until the flip-flop 76 is reset by a first pulse. The tone counter 40 therefore makes the first monostable multivibrator 46 produce first pulse of the repetition period $(6 \times 10 + 8)/(440 \times 216)$ or $(6 \times 12 + 8)/(440 \times 216)$ second. For each of the tones Es, Ges, As, and B, the AND and Exclusive OR gates 71 through 74 produce a correction signal 1001 (binary nine) in response to the binary codes 1000, 1001, 1010, and 1100 when the flip-flop 76 is in the reset state. The four-input NAND gate 65 makes the correction monostable multivibrator 66 produce a clear pulse to clear the binary counter 60 when the latter counts nine tone clock pulses. After the flip-flop 76 is set by the clear pulse, the AND and Exclusive OR gates 71 through 74 produce a correction signal 0110. The binary counter 60 thus acting again as a one-sixth frequency divider until the flip-flop 76 is reset by the next following first pulse, the tone counter 40 makes the first monostable multivibrator 46 produce first pulse of the repetition period $(6 \times 7 + 9)/(440 \times 216)$, $(6 \times 8 + 9)/(440 \times 216)$, $(6 \times 10 + 9)/(440 \times 216)$, or $(6 \times 12 + 9)/(440 \times 216)$ second. For the tone Des, the AND and Exclusive OR gates 71 through 74 produce a correction signal 1100 (binary twelve) in response to the binary code 1101 when the flip-flop 76 is in the reset state. The four-input NAND gate 65 therefore makes the correction monostable multivibrator 66 produce a clear pulse when the binary counter 60 counts twelve tone clock pulses. After the flip-flop 76 is set by the clear pulse, the correction logic 70 produces a correction signal 0110 until the flip-flop 76 is reset by the next following first pulse. The tone counter 40 consequently makes the first monostable multivibrator 40 produce first pulses of the repetition period $(6 \times 12 + 12)/(440 \times 216)$ second. It is now understood that the instrument illustrated with reference to FIG. 4 may be furnished with more exact correction capabilities to approximate tones selected from a scale of Bosanquet's equal temperament or the like by increasing the capacity of the controllable binary counter 60.

Figure 5:
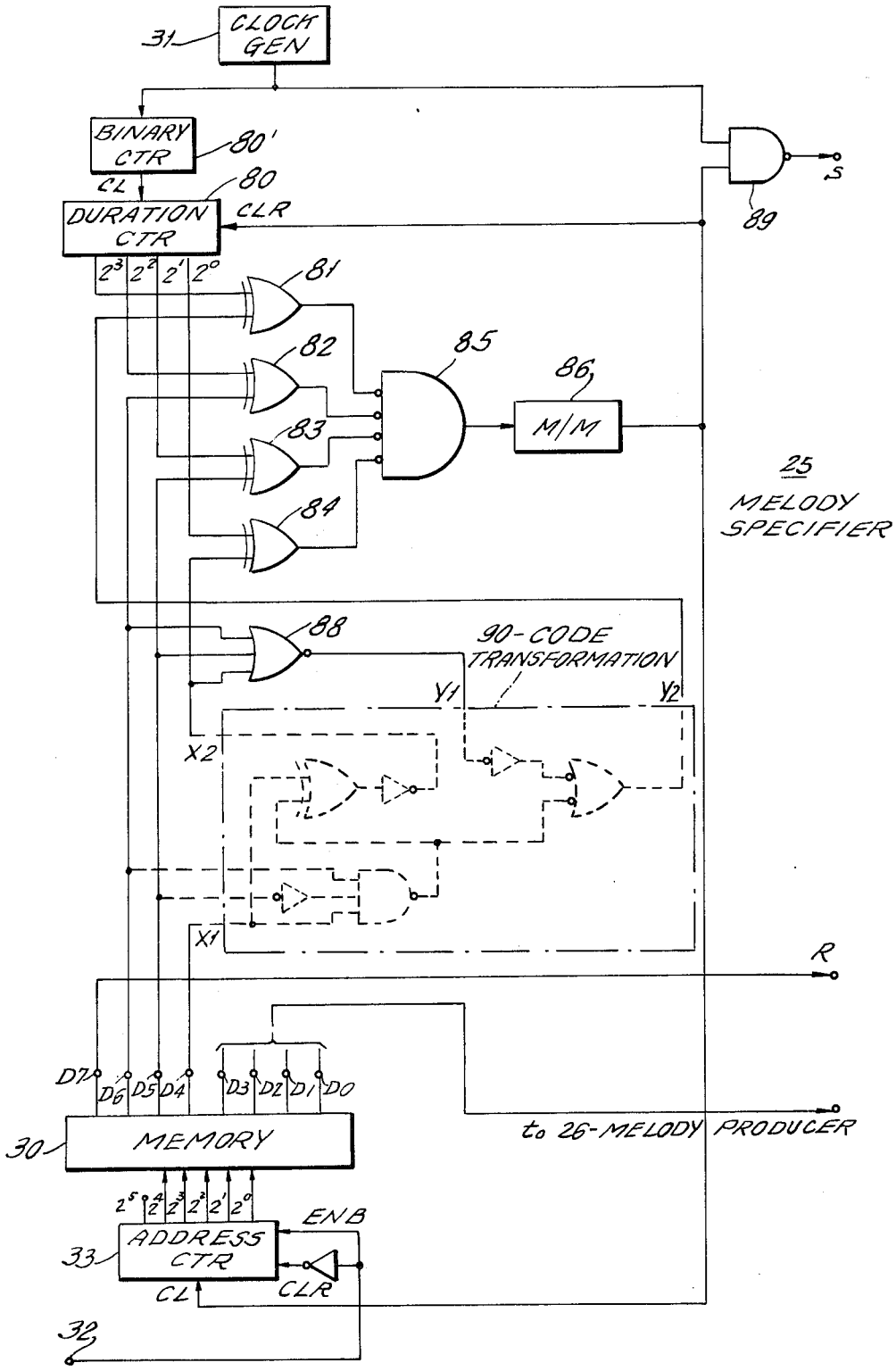
FIG. 5 is a partial block diagram of an electric musical instrument according to a fourth embodiment of this invention.

Referring now to FIG. 5, an electric musical instrument according to a fourth embodiment of this invention comprises a melody specifying signal producer 25 wherein durations of the tones and rests are electrically digitally controllable rather than by the number of addresses in the memory 30. In order so to do, durations ofnotes and rests are encoded as given in Table 5.

Table 5

| Note or rest | Relative duration | Binary | Bin. code |
|---|---|---|---|
| sixteenth | 1 | 001 | 001 |
| eighth | 2 | 010 | 010 |
| eighth with a dot | 3 | 011 | 011 |
| quarter | 4 | 100 | 100 |
| quarter with a dot | 6 | 110 | 110 |
| quarter with two dots | 7 | 111 | 111 |
| half | 8 | 1000 | 000 |
| half with a dot | 12 | 1100 | 101 |

Although use may be made in a melody of 1/64 notes or rests or whole notes or rests or even notes or rests of longer durations, it is seldom that the durations of notes and rests in a melody step out of the relative duration given in Table 5. Moreover, it is usual that the relative durations are between the sixteenth and second notes or rests, both ends inclusive.

Referring more closely to FIG. 5, an instrument according to the fourth embodiment comprises a melody specifier 25 comprising, in turn, similar elements designated with like reference numerals as in FIG. 2. Besides the signal terminals D0 through D3 for the melody specifying binary signals, the melody specifier 25 has three additional signal terminals D4, D5, and D6 for duration specifying binary signals and a single further additional signal terminal D7 for a rhythm of meter signal R which, if used, controls an amplifier (not shown) placed prior to the electroacoustic transducer M to make the latter produce the melody in accordance with the rhythm. The memory 30 may be an eight-bit 32-word read-only memory. Rather than supplied directly to the clock terminal CL of the address counter 33, the best clock pulses are supplied to the same from the beat clock generator 31 through a binary counter 80' for twice multiplying the beat clock period and thereafter through a duration logic. The duration logic comprises a three-bit binary duration counter 80. Although the repitition period is twice longer, pulses supplied to a clock terminal CL of the duration counter 80 from the binary counter 80' may nevertheless be called the beat clock pulses. The duration counter 80 counts the beat clock pulses and supplies beat count signals to first, second, third, and fourth Exclusive OR gates 81, 82, 83, and 84 for the most through least significant digits of the beat count signals. Pulses produced as will soon be described are supplied, through a four-input NAND gate 85, to a third monostable multivibrator 86 which produces a clear pulse of a pulse width between a half and a whole beat clock period in response to transition from logic 0 to logic 1 of the input signal thereto to clear the duration counter 80. The clear pulse is supplied also to the clock terminal CL of the address counter 33.

When the relative durations are represented by duration binary integers 001 through 1000, the most through least significant digits of the duration binary codes 000 through 111 are supplied from the signal terminals D5 through D3 to the second through fourth Exclusive OR gates 82 through 84 for the next through least significant digits of the beat count signals, a line X1 being connected directly to another line X2. A code transformation NOR gate 88 transforms the duration binary code 000 to the duration binary integer 1000 and supplies the most significant digit of the latter to the first Exclusive OR gate 81, a line Y1 being connected directly to another line Y2. It will be understood that the clear pulse clears the duration counter 80 each time when the counts given thereby reach the duration integer and advances the address counter 33. The short-period beat clock pulses and the clear pulse are supplied to an interval NAND gate 89, which produces a logic 0 interval signal S for stopping production of the melody at the beginning of each musical sound for a very short duration equal to about a thirty-second rest. When all relative durations listed in Table 5 are necessary, the binary codes 000 and 101 are transformed to the duration integers 1000 and 1100 by the transformation NOR gate 88 and a transformation logic 90 depicted in FIG. 5 with broken lines.

While this invention has thus far been described in conjunction with several preferred embodiments thereof and various modifications, it is to be understod that the counter used throughout the illustrations may be either an up or a down counter. The melody as called herein may be a sequence of musical sounds and rests of harmony. Furthermore, it is readily possible by those skilled in the electric instrument art to combine an electric instrument described hereinabove with a tone conversion circuit for producing tone qualities of various instruments to the melody and/or an on-off circuit corresponding to the tremolo stop. Such additional control of the melody production may be encoded and stored in a memory 30 together with a code for the tempo for controlling the beat clock period and with another code for the muliplicity of time for controlling production of the rhythm signal R. If it is desired to produce several sequence of melody for giving harmonies, use may be made of a plurality of melody producers. A melody specifier 25 therefor, if used, may comprise a single common set of the beat clock generator 31 and address counter 33 which are utilized by a plurality of memories.

What is claimed is:

1. An instrument for electrically digitally producing a melody comprising musical sounds of a musical scale consisting of a plurality of tones within an octave, said tones having fundamental periods equal to a predetermined period multiplied by tone integers, said plurality in number, which comprises:

first means for producing, in compliance with said melody, pitch binary signals, each comprising a plurality of digits representative of pitch integers, the pitch integers being related to said tone integers to specify said musical sounds;

a tone clock generator for producing a train of tone clock pulses of a tone clock period equal to a rational multiple of said predetermined period;

second means responsive to said clock pulses and binary signals for producing electric pulse groups, the electric pulses in said pulse groups having repetition periods equal to said predetermined period multiplied by the tone integers to which the pitch integers said binary signals are representative of are related;

third means responsive to said pulse groups for producing said melody;

said second means further comprising controllable frequency divider means responsive to said clock pulses and binary signals for producing said electric pulses by successively multiplying said clock period by the tone integers to which the pitch integers said binary signals are representative of are related;

said tone integers comprising at least two first tone integers and at least one second tone integer, said first tone intergers being equal to a common measure multipled by integral factors, said second tone integer being equal to the algebraic sum of said common measure multiplied by an integral factor for said second tone integer plus a correction not greater in absolute value than about one-tenth of said second tone integer, said pitch binary signals comprising first and second binary signals, the pitch integers of said first binary signals being first pitch integers equal to the integral factors for said first tone integers, the pitch integers of said second binary signals being second pitch integers equal to said integral factor for said second tone integer, wherein said frequency divider means comprises:

a controllable binary counter responsive to tone pulses for successively producing tone count signals representative of counts of said tone pulses;

fourth means responsive to said clock and electric pulses and first and second binary signals for supplying said tone pulses to said binary counter;

means responsive to said electric pulses for clearing said binary counter; and tone logic means responsive to said count and first and second binary signals for producing said electric pulses every time when the counts said count signals are representative of reach the integral factors which the plurality of digits of said first and second binary signals are representative of.

2. An instrument as claimed in claim 4, wherein said fourth means comprises:

a frequency divider responsive to input pulses for producing said tone pulses by frequency dividing said input pulses by said common measure; and correction logic means responsive to said clock and electric pulses for supplying, in response to said first binary signals, said clock pulses to said frequency divider as said input pulses and for modifying, in response to said second binary signals, said clock pulse, equal in number to said common multiple multiplied by said integral factor for said second tone integer, into said input pulses, equal in number to said algebraic sum.

3. An instrument as claimed in claim 1, wherein said fourth means comprises second controllable frequency divider mans responsive to said clock and electric pulses and first and second binary signals for producing said tone pulses by successively multiplying said clock period by the integral factors which the plurality of digits of said first and second binary signals are representative of.

4. An instrument as claimed in claim 3, wherein said second controllable frequency divider means comprises:

a second controllable binary counter responsive to said clock pulses for successively producing second count signals representative of counts of said clock pulses;

means responsive to said tone pulses for clearing said second controllable binary counter; and correction logic means responsive to said second count and first and second binary signals and electric pulses for producing a sequence of the tone pulses each time when the counts said second count signals are representative of reach, when summed up during each of said repetition periods, a relevant one of said first and second tone integers to which said first and second pitch integers are related.

5. An instrument as claimed in claim 4, wherein said correction logic means comprises:

a two-state circuit put into a first state in response to each of said tone pulses and into a second state in response to each of said electric pulses;

first wired logics operatively coupled to said two-state circuit for producing, in response to each of said first binary signals when said two-state circuit is in whichever of said first and second states and in response to each of said second binary signals when said two-state circuit is in said first state, a first control signal representative of a first count and for producing, in response to each of said second binary signals when said two-state circuit is in said second state, a second control signal representative of a second count, a sum of the first counts the first control signals produced in each of said repetition periods are representative of being equal to said first tone integer, a sum of the first and second counts the first and second control signals produced in each of said repetition periods are representative of being equal to said second tone integer; and second wired logics responsive to said second count signals and said first and second control signals for producing said tone pulses every time when the counts said second count signals are representative of reach whichever of said first and second counts.

6. An instrument for electrically producing a melody comprising musical sounds of a musical scale consisting of a plurality of tones within an octave, said tones having fundamental periods equal to a predetermined period multiplied by tone integers, said plurality in number, which comprises:

first means for producing, in compliance with said melody, pitch binary signals, each comprising a plurality of digits representative of pitch integers, the pitch integers being related to said tone integers to specify said musical sounds;

a tone clock generator for producing a train of tone clock pulses of a tone clock period equal to a rational multiple of said predetermined period;

second means responsive to said clock pulses and binary signals for producing electric pulse groups, the electric pulses in said pulse groups having repetition periods equal to said predetermined period multiplied by the tone integers to which the pitch integers said binary signals are representative of are related;

third means responsive to said pulse groups for producing said melody;

each of said binary signals comprising a predetermined digit that represents one of two binary numbers in a first of said binary signals and the other of the two binary numbers in a second of said binary signals, said one binary number specifying a musical sound that is an inversion of another musical sound specified by said other binary number, wherein said third means comprises:

octave frequency divider means responsive to the predetermined digits of said binary signals and to said electric pulses for twice multiplying the repetition periods to produce frequency-divided pulses every time when said predetermined digits are representative of said one binary number; and means responsive to the electric pulses produced in response to the second binary signals and to said frequency-divided pulses for producing said melody.

* * * * *

UNITED STATES PATENT AND TRADEMARK OFFICE

CERTIFICATE OF CORRECTION

PATENT NO. : 4,043,240

DATED : August 23, 1977

INVENTOR(S) : Fumio Ando

It is certified that error appears in the above-identified patent and that said Letters Patent are hereby corrected as shown below:

Front page of Patent in Section [30] dealing with "Foreign Application Priority Data" should have added thereto:

June 23, 1975 Japan 50-77218

December 10, 1975 Japan 50-147,567

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*